US008413841B2

(12) United States Patent
Cunningham

(10) Patent No.: US 8,413,841 B2
(45) Date of Patent: Apr. 9, 2013

(54) APPARATUS FOR CONTAINMENT AND CONCENTRATION OF VOLATILE ESTERS

(76) Inventor: Randy Mark Cunningham, Roseville, CA (US)

( * ) Notice: Subject to any disclaimer, the term of this patent is extended or adjusted under 35 U.S.C. 154(b) by 268 days.

(21) Appl. No.: 11/621,112

(22) Filed: Jan. 8, 2007

(65) Prior Publication Data

US 2007/0158356 A1 Jul. 12, 2007

Related U.S. Application Data

(60) Provisional application No. 60/757,218, filed on Jan. 9, 2006.

(51) Int. Cl.
*B65D 43/08* (2006.01)

(52) U.S. Cl. ..... 220/796

(58) Field of Classification Search ..... 220/796, 220/799, 801, 802
See application file for complete search history.

(56) References Cited

U.S. PATENT DOCUMENTS

| | | | | | |
|---|---|---|---|---|---|
| 3,442,435 | A | * | 5/1969 | Huston et al. | 220/528 |
| 3,655,089 | A | * | 4/1972 | Tower | 220/287 |
| 4,331,255 | A | | 5/1982 | Fournier | |
| 4,934,558 | A | * | 6/1990 | Vargas | 220/287 |
| 5,102,002 | A | * | 4/1992 | Whitley | 220/823 |
| 5,183,172 | A | * | 2/1993 | Boller | 220/270 |
| 5,514,299 | A | | 5/1996 | Kalwara | |

OTHER PUBLICATIONS

Clive Michelsen, Tasting and Grading Wine, Book, 2005, pp. 30-31 and 66-67, JAC International AB, Limhamn, Sweden.
Malmo Wine Academy, Professional Wine Tasting Kit products, www.malmo-wine-academy.com/products.pdf, pp. 1, 3 and 5.
Malmo Wine Academy, "New! Wine Activity Kit", web-page image, www.malmo-wine-academy.com.
Blaine Copenheaver, Internat'l Searching Authority, Written Opinion, PCT/US07/60282, Nov. 19, 2007, five (5) pages, US.
Electronic Book Cover and Publication Information for Michelsen, Clive S., Tasting and Grading Wine, Book, Aug. 2005, www.openlibrary.org (http://openlibrary.org/works/OL9766437W/Tasting_and_Grading_Wine).

* cited by examiner

*Primary Examiner* — Harry Grosso
(74) *Attorney, Agent, or Firm* — Uriarte Law

(57) ABSTRACT

An apparatus and method are disclosed and pertain to a lid for use with a container having a rim and an opening where volatile esters from an aromatic compound are dispersing into the environment and for enhancing the identification of the volatile esters. The lid is comprised of a generally planar laterally stabilized gas restrictive material for decreasing the dispersion rate of the volatile esters, resulting in increased concentration of the volatile esters within the container and enhancing the identification of the volatile esters emitted from the aromatic compound. The lid includes a surface for coupling to the rim in a manner that laterally stabilizes the lid so that it remains sufficiently fixed to the rim during agitation of the container. The surface also permits the lid to be removed from the rim.

6 Claims, 5 Drawing Sheets

APPARATUS FOR CONTAINMENT AND CONCENTRATION OF VOLATILE ESTERS

CROSS-REFERENCE TO RELATED APPLICATIONS

This application claims the benefit of Provisional Application 60/757,218, filed Jan. 9, 2006 and entitled "Device for Containment and Concentration of Volatile Ester Compounds".

BACKGROUND (1) Technical Field

The present invention relates to beverage containers, specifically to a lid type device for increasing the concentration of or containing volatile ester compounds within a wine glass.

(2) Background Art

Previously, devices used to prevent the dispersion of volatile ester compounds, also referred to as volatile esters or ester molecules, have been used primarily in the disciplines of chemistry, enology and biology.

In the field of chemistry, the traditional method of covering a container containing a compound that emits volatile esters has been through the use of the 'watch glass' cover. The watch glass covers noted above are concave and constructed from temperature resistant glass. Disadvantages of the watch glass reside in that they are bulky, breakable, relatively expensive to manufacture, and do not contain an effective lateral stabilization feature. In the absence of a lateral stabilization feature, the watch glass requires the use of both hands, one hand to hold the watch glass on the container while the other hand is used to swirl and agitate the aromatic compound inside the container to release additional volatile esters. The watch glass is saucer shaped which affords only the slightest lateral stabilization when placed on top of the container opening with the curved shape of the watch glass sitting just slightly inside the opening of the container. Furthermore, the coefficient of static friction for a watch glass on a glass beverage container is very low and always requires the use of two hands to retain the watch glass and swirl the beverage container.

In the field of enology, wine makers have employed the use of chemistry laboratory watch glasses placed on wine glasses as volatile ester containment lids. Lack of lateral stabilization requires the use of two hands to hold the watch glass securely, while swirling and agitating the wine in the glass to promote the release of volatile esters from the wine.

Additionally, in a sub-field of enology, wine education, wine instructors have employed the use of chemistry lab watch glasses as volatile ester containment lids placed on wine glasses. Again lack of lateral stabilization requires the use of two hands to hold the watch glass securely, while swirling and agitating the wine in the glass to promote the release of volatile esters.

In the field of biology one method for covering containers holding aromatic compounds has been the use of the Petri dish cover. While Petri dish covers are lighter, less bulky and less expensive to manufacture as compared to watch glasses they are still disadvantaged by their lack of a lateral stabilization feature. Additionally, Petri dishes are fragile since they are fabricated from thin inexpensive plastic. Low cost allows Petri dish covers to be a 'one use' disposable use model. Furthermore, the coefficient of static friction for a Petri dish cover on a glass beverage container is also very low, thus creating the disadvantage of requiring the use of two hands, one to retain the Petri dish cover and one to swirl the container holding the aromatic compound to promote the release of volatile esters.

SUMMARY

Disclosed are various embodiments of a lid for use with a container having a rim and an opening where volatile esters from an aromatic compound are dispersing into the environment and for enhancing the identification of the volatile esters. The lid is comprised of a generally planar laterally stabilized gas restrictive material for decreasing the dispersion rate of the volatile esters, resulting in increased concentration of the volatile esters within the container and enhancing the identification of the volatile esters emitted from the aromatic compound. The lid includes a surface for coupling to the rim in a manner that laterally stabilizes the lid so that it remains sufficiently fixed to the rim during agitation of the container. The surface also permits the lid to be removed from the rim.

DETAILED DESCRIPTION OF THE INVENTION

In the following detailed description, for purposes of explanation, numerous specific details are set forth to provide a thorough understanding of the various embodiments of the present invention. Those of ordinary skill in the art will realize that these various embodiments of the present invention are illustrative only and are not intended to be limiting in any way. Other embodiments of the present invention will readily suggest themselves to such skilled persons having benefit of the herein disclosure.

In addition, for clarity purposes, not all of the routine features of the embodiments described herein are shown or described. It is appreciated that in the development of any such actual implementation, numerous implementation-specific decisions must be made to achieve the developer's specific goals. These specific goals will vary from one implementation to another and from one developer to another.

Moreover, it will be appreciated that such a development effort might be complex and time-consuming but would nevertheless be a routine engineering undertaking for those of ordinary skill in the art having the benefit of the herein disclosure.

The various embodiments of the present invention that are taught herein disclose a simple, inexpensive, durable, laterally stabilized, gas restrictive lid, named "Lid", for containing, concentrating or both, volatile esters dispersing from a container, such as a wine glass, that contains an aromatic compound, such as wine.

Figure 1:
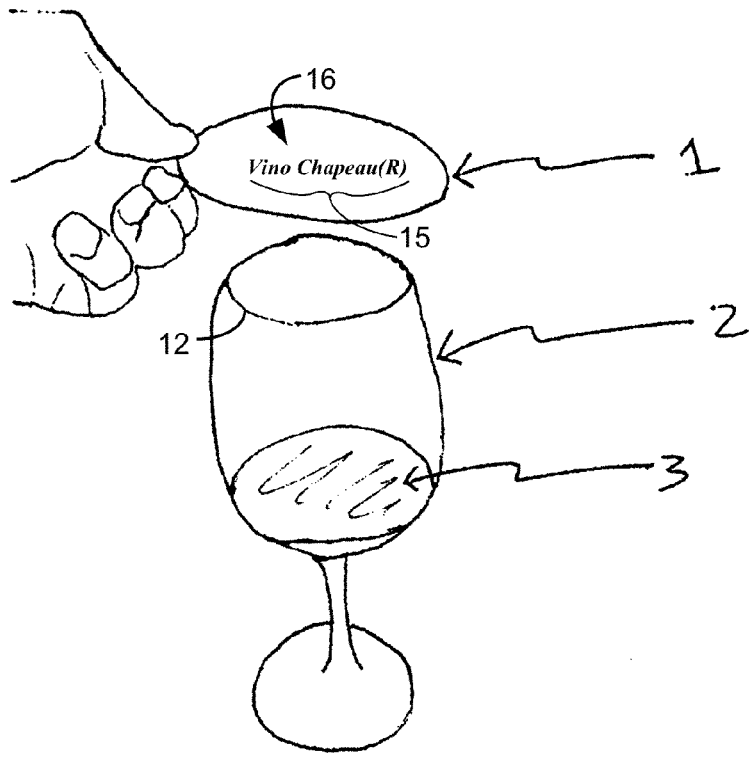
FIG. 1 is a perspective illustration showing a lid for containing volatile esters dispersing from an aromatic compound held above a container in accordance with one embodiment of the present invention.
Figure 2:
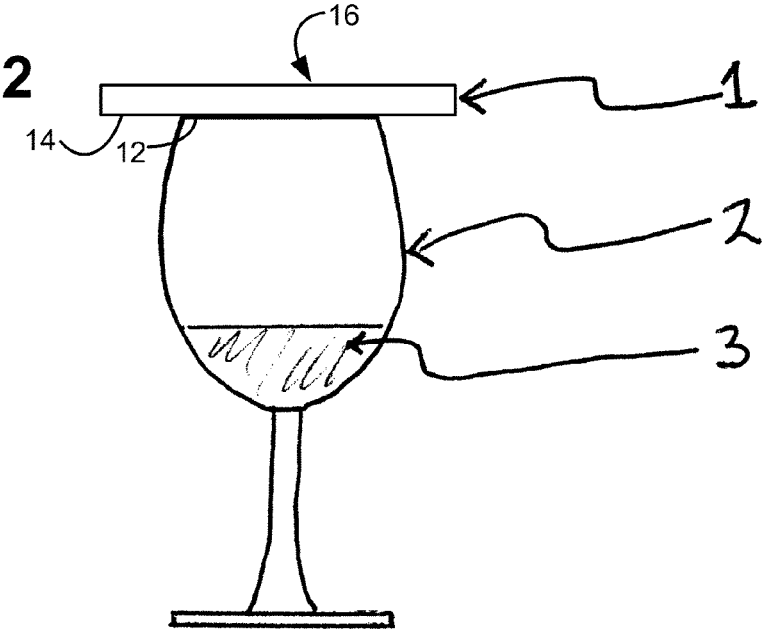
FIG. 2 is a side view illustration showing the lid attached to the rim of the container.

Referring now to the drawings, FIG. 1 is a perspective illustration showing a Lid 1 for containing volatile esters (not shown) dispersing from an aromatic compound 3 held above a container 2 in accordance with one embodiment of the present invention, while FIG. 2 is a side view illustration showing Lid 1 attached to a rim 12 of container 2 by a coefficient of static friction sufficient to keep Lid 1 from slipping on rim 12 when container 2 is agitated.

Lid 1 may be implemented in the form of an approximately planar, circular and clear vinyl sheeting approximately 4 to 60 mils thick although in the example shown in FIGS. 1 and 2 it is contemplated that Lid 1 have a thickness of approximately between 10 and 20 mils. Lid 1 may also be implemented to have a diameter of approximately between 40 mm and 120 mm. In operation, a user couples Lid 1 to a container 2, such as a wine glass or equivalent beverage glass, containing an aromatic compound, such as wine, that includes volatile esters. This permits the user to limit the amount of volatile esters dispersing from container 2.

Lid 1 may be used to cover the opening of container 2 by coupling a surface 14 of Lid 1 directly onto rim 12 of container 2. Covering the opening of container 2, contains the volatile esters emitted from aromatic compound 3, increasing the concentration of these volatile esters within the interior volume of container 2 until they reach equilibrium. By virtue of the material properties of surface 14, which in this example is fabricated from vinyl sheeting, in combination with rim 12, the resulting coefficient of static friction at the point of contact, named contact interface, between the rim and surface 14 is very high. The high coefficient of static friction present at the contact interface between surface 14 and rim 12 results in excellent lateral stability and retention of the Lid 1. This permits Lid 1 to remain coupled to container 2 when container 2 is agitated, such as when container 2 is used to hold wine and moved in a swirling pattern to agitate the wine, promoting the release of additional volatile esters.

It is currently contemplated that the coefficient of static friction provided by vinyl sheeting that has a thickness of between 10 and 20 mils is greater than 0.40. The use of vinyl sheeting to provide this amount of coefficient of static friction between surface 14 and rim 12 is not intended to be limiting in any way. Any equivalent material may be used that will provide a coefficient of static friction sufficient to keep Lid 1 attached to rim 12 while container 2 is agitated sufficiently to permit aromatic compound 3 to swirl within container 2 and without the use of a user's hand to keep Lid 1 in place. In the embodiment shown in FIGS. 1 and 2, Lid 1 and surface 14 are formed from a single piece of vinyl material although this approach is not intended to be limiting in any way. For example, Lid 1 and surface 14 may be separate pieces joined together with Lid comprised of any material sufficient for the purposes disclosed herein, while surface 14 may be comprised of any material that provides lateral stabilization of Lid 1 through static friction when surface 14 is placed on rim 12.

It is concurrently contemplated that vinyl sheeting also provides an additional friction factor since when at a selected thickness within the range given above and at a given temperature, the vinyl sheeting slightly deforms or dents at the contact interface between the rim of the container, such as rim 12, and the vinyl sheeting, which further increases the lateral stability of Lid 1. The width of the rim edge contacting the vinyl sheeting or any equivalent material that slightly deforms also determines the amount of lateral stability provided to Lid 1. The thinner or sharper the rim edge the higher the friction factor provided.

The circular shape and transparency of Lid 1 is not intended to be limiting in any way although the circular shape of Lid 1 should have a diameter that at least exceeds the diameter of the opening of the container contemplated for use with Lid 1. The translucent nature of Lid 1 facilitates visualization of aromatic compound 3. To improve user visibility and handling of Lid 1, Lid 1 may include markings 15 on a selected location, such as top surface 16.

Further, the thickness of 10 to 20 mils is also intended not to limit the example shown in any way. Using a 10 to 20 mils thick vinyl sheeting to implement Lid 1 minimizes sagging, which facilitates handling, increases the surface area of the Lid 1 that can contain, concentrate or both the volatile esters in container 2.

In a further alternative embodiment (not shown), the lateral stability of Lid 1 may also be achieved by the application of a low-tack adhesive compound to a surface, such as surface 14, of Lid 1 that is intended to contact and adhere to rim 12. Moreover, materials of alternate composition may be used as well, such as plastic, paper or plastic laminated paper.

This low-tack adhesive compound can be similar in adhesive strength to the low-tack adhesive used on Post-it® Notes, which is available from 3M Company of Saint Paul, Minn. Low-tack Lids could be stacked in pads similar to pads of Post-it® Notes for convenient storage and dispensing. As a result of the very low cost of paper materials, this embodiment provides Lids that support a disposable, one time use, use model, providing convenience to users and providers of such Lids.

Figure 3:
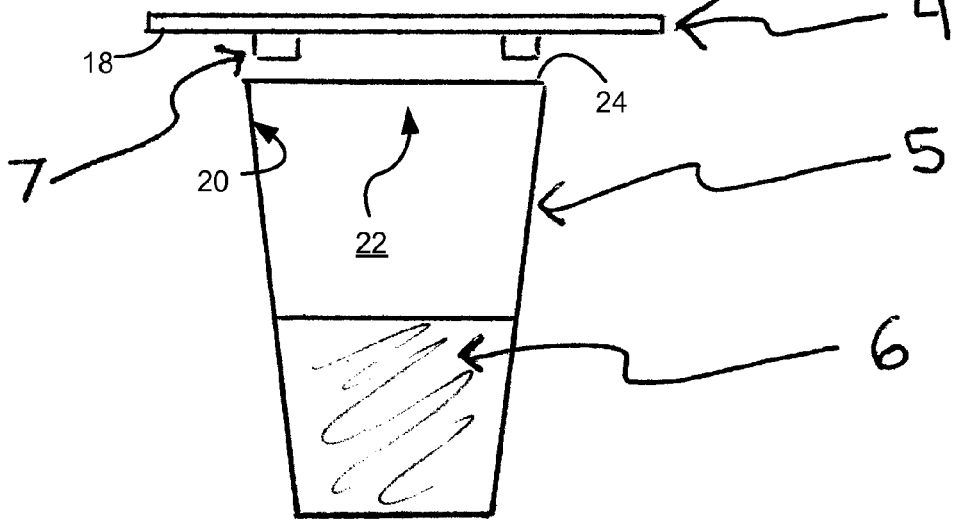
FIG. 3 is a side view illustration showing a lid with internal lateral stabilization features and a container in accordance with another embodiment of the present invention.
Figure 4:
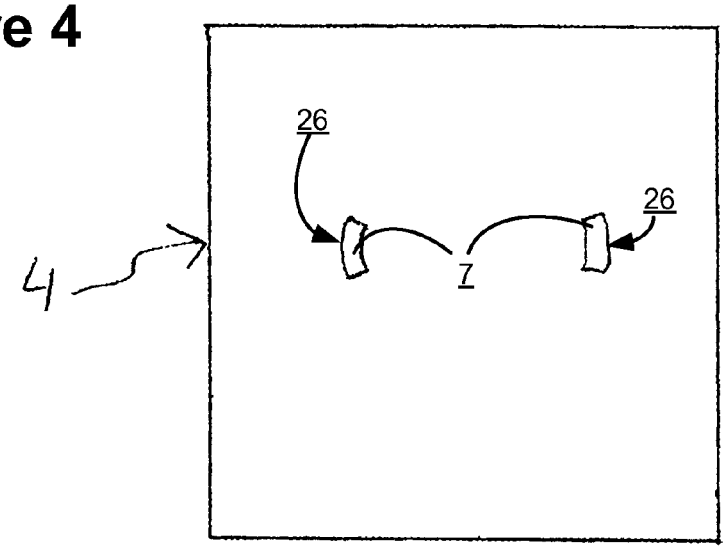
FIG. 4 shows a bottom view of the lid element disclosed previously in FIG. 3.

With reference to FIGS. 3 and 4, lateral stability of a Lid 4 may alternately be achieved through the addition of lateral stabilization elements 7, such as flanges, that protrude from a bottom surface 18 of Lid 4 so that elements 7 contact an inner surface 20 of a container 5 when Lid 4 is placed onto a rim 24. Lateral stabilization elements 7 prevent lateral displacement during swirling motions intended to agitate an aromatic compound 6, such as wine, inside container 5 and to promote the release of volatile esters (not shown). Lateral stabilization is achieved by the contact between an outside edge 26 of a lateral stabilization element 7 and inner surface 20.

The number of lateral stabilization elements used in the construction of Lid 4 may be any number although in the embodiment shown in FIGS. 3 and 4, two lateral stabilization elements are shown. For example and in an alternative embodiment (not shown), a set of lateral stabilization elements 7 may be formed or fabricated on bottom surface 18 so that they collectively form a generally circular downwardly protruding feature that has an outside diameter smaller than the diameter of opening 22. The use of a generally circular shape is not intended to be limiting in any way but other shapes may be used, depending on the shape of opening 22 employed by container 5.

Figure 5:
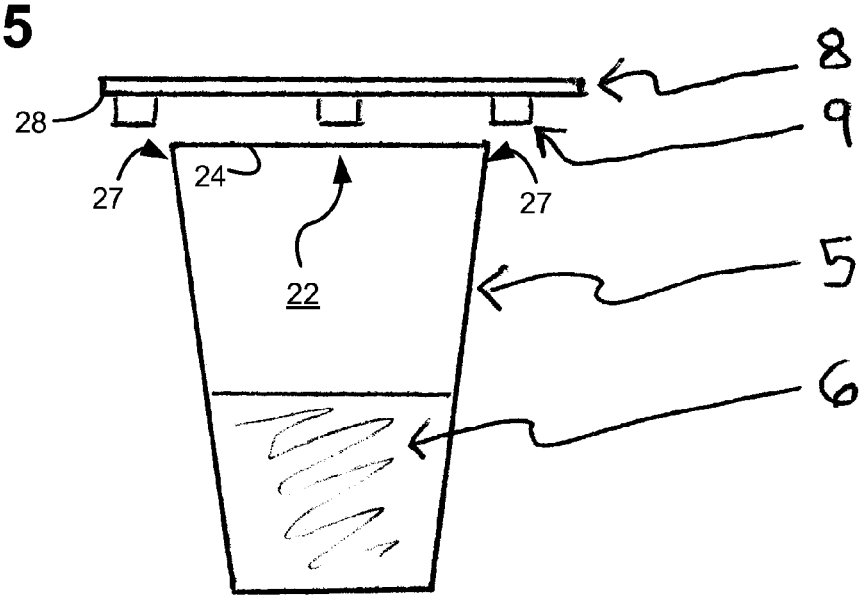
FIG. 5 is a side view illustration showing a lid with external lateral stabilization features and a container in accordance with yet another embodiment of the present invention.
Figure 6:
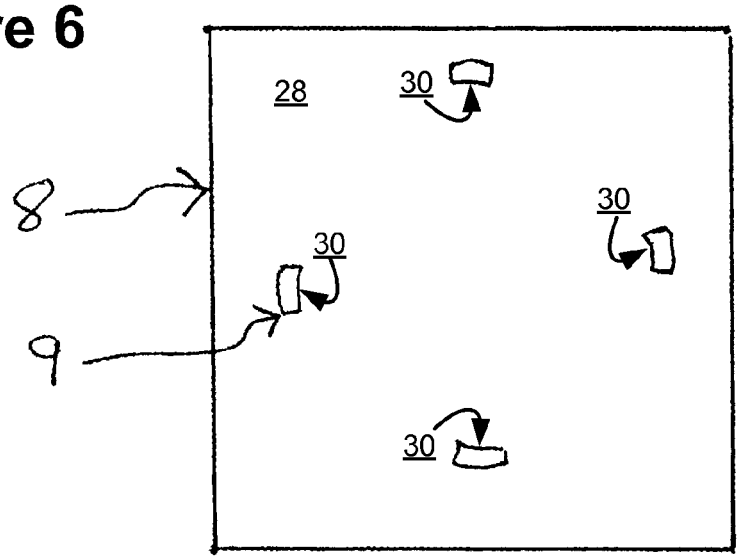
FIG. 6 shows a bottom view of the lid disclosed previously in FIG. 5.

FIGS. 5 and 6 illustrate another embodiment of the present invention where a Lid 8 provides lateral stabilization when placed on rim 24 of container 5 through the use of lateral stabilization elements 9 orientated so that they contact an outer surface 26 of container 5, such as a beverage glass, that contains an aromatic compound 6, such as wine. These elements 9 project from bottom surface 28. When Lid 8 is coupled to container 5, lateral stabilization elements 9 protrude toward container 5, providing lateral stability through contact between inside edges 30 and outer surface 27.

Although in the current example four lateral stabilization elements 9 are employed to provide lateral stabilization of the Lid 8 when placed on container 5 any number of lateral stabilization elements 9 maybe attached or formed on bottom surface 28. For example and in an alternative embodiment (not shown), a set of lateral stabilization elements 9 may be formed or fabricated on bottom surface 28 so that they collectively form a generally circular downwardly protruding feature that has an outside diameter greater than the diameter of opening 22. The use of a generally circular shape is not intended to be limiting in any way but other shapes may be used, depending on the shape of opening 22 employed by container 5.

Figure 7:
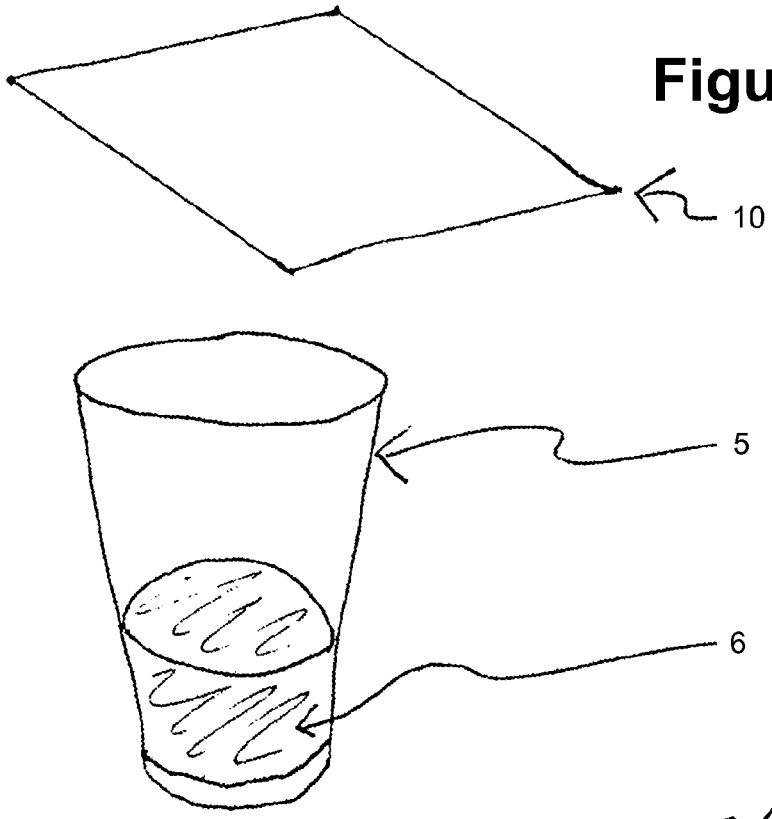
FIG. 7 is a perspective illustration showing a non-porous lid above a container in accordance with another embodiment of the present invention.
Figure 8:
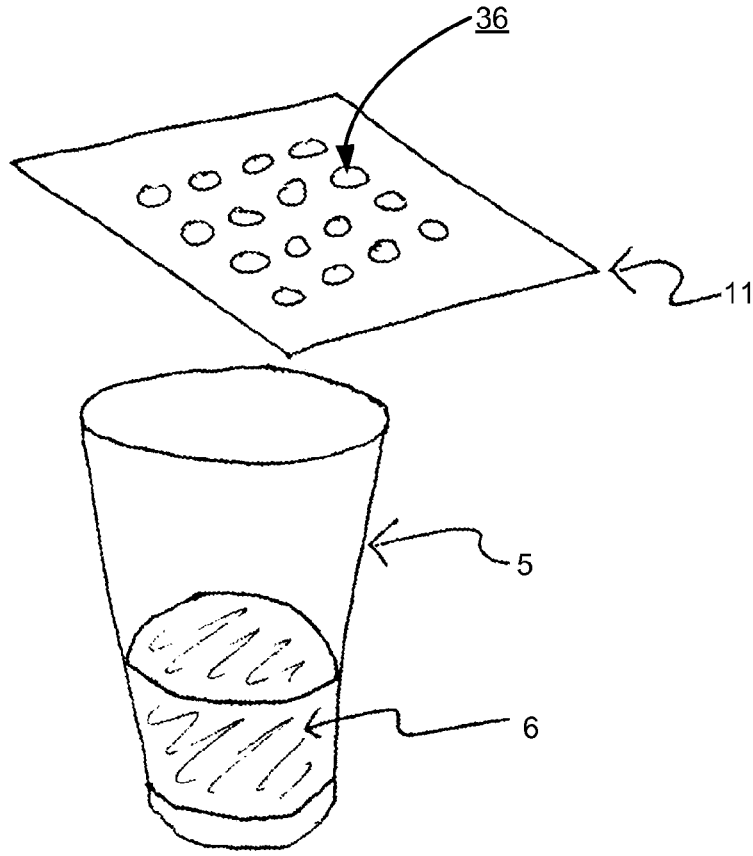
FIG. 8 is a perspective illustration showing a porous lid covering above a container in accordance with another embodiment of the present invention.

The various embodiments of the Lids disclosed herein may be each implemented in the form of a solid non-porous element or may be constructed as a perforated element, or mesh, with one or more holes. In FIGS. 7 and 8, a non-porous Lid 10 and a porous Lid 11 for coupling with a container 5, such as a beverage glass, containing an aromatic compound 6, such as wine, are respectively disclosed. When coupled to container 5, non-porous Lid 10 creates a maximum concentration of volatile esters compounds released from the aromatic compound 6 when in equilibrium. Alternately in FIG. 8, coupling porous Lid 11 to container 5 results in a concentration of volatile esters to be less than the maximum. The diameter and count of holes present in porous Lid 11 control the dispersion rate of volatile esters such that the resulting concentration of volatile esters, at equilibrium, within container 5 is proportionately lower than the concentration of volatile esters, at equilibrium, achieved using non-porous Lid 10. The size, quantity, shape and location of holes 36 in porous Lid 11 may be optimized to aid or restrict the passage of specific volatile esters compounds of varying molecular weights such as wood esters, alcohol esters, and fruit esters emitted from aromatic compound 6.

Figure 9:
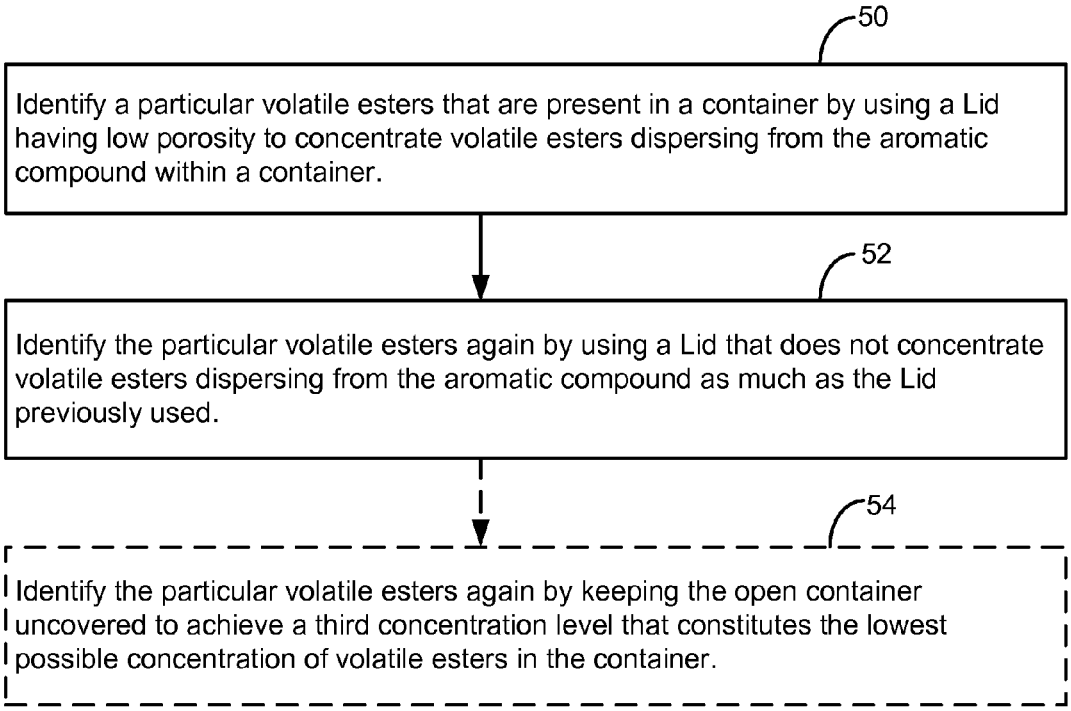
FIG. 9 illustrates a method of volatile ester identification training in accordance with yet another embodiment of the present invention.

Referring now to FIG. 9, a method for improving the accuracy of volatile ester identification is disclosed in accordance with another embodiment of the present invention. The method includes using a perforated or porous Lid, such as Lid 11 in FIG. 8, in sequence with a solid non-porous Lid, such as Lid 10 in FIG. 7, to support volatile ester identification training.

A particular aromatic compound, such as wine, emitting a volatile ester, such as nutmeg, that is present in a container is identified 50 by using a Lid that has low or no porosity to concentrate volatile esters dispersing from the aromatic compound within the container. For example, the first Lid may be implemented in the form of Lid 10, and is used to identify a volatile ester. This includes coupling Lid 10 to the container so that volatile esters dispersing from the aromatic compound concentrate within the container. The dispersion of volatile esters may be further increased by agitating the container so as its contents swirl within the container. The concentration of these volatile esters facilitates through the sense of smell the identification of these volatile esters when a user removes Lid 10 from the container.

The user may again attempt to identify 52 the volatile ester but uses a Lid that does not concentrate volatile esters dispersing from the aromatic compound as well as the prior Lid used. For example, the user may use a porous Lid, such as Lid 11, by coupling Lid 11 to the container and again attempt to identify volatile esters dispersing from the aromatic compound, which are now retained at a lower concentration by Lid 11. Thus, by using solid and perforated Lids in sequence, the user can practice the identification of aromatic compounds at varying concentrations.

As an additional and optional embodiment, the user may utilize 54 the open container with no containment lid of any type to achieve a third concentration level that constitutes the lowest possible concentration of volatile esters in the container.

The use of laterally stabilized Lids, such as Lids 10 and 11, in the example method above is not intended to limit this embodiment of the present invention any way. Other porous and non-porous Lids that do not have the laterally stabilization embodiments disclosed herein may be used to practice the method disclosed.

While the present invention has been described in particular embodiments, it should be appreciated that the present invention should not be construed as limited by such embodiments. Rather, the present invention should be construed according to the claims below.

I claim:

1. An apparatus for use with a container having a rim and an opening where volatile esters from an aromatic compound are dispersing into the environment and for enhancing the identification of said volatile esters, the apparatus comprising:

a laterally-stabilized planar gas restrictive lid for decreasing the dispersion rate of the volatile esters, resulting in increased concentration of the volatile esters within the container and enhancing the identification of the volatile esters, said lid having a surface for coupling to the rim, said surface disposed to have a continuously flat surface;

said lid further including a bottom surface that includes said surface for coupling to the rim, said bottom surface disposed to have a continuously flat surface across the entire width of said lid so that said surface for coupling to the rim does not contact the sides of the rim;

said lid disposed with a coefficient of static friction at a contact interface between said surface and the rim, said coefficient of static friction providing lateral stabilization that enables said lid to remain coupled to the rim without slipping when the aromatic compound is agitated; and said coefficient of static friction having a value of greater than 0.4 at said contact interface.

2. The apparatus of claim 1, wherein said lid is solid and obstructs passage of volatile esters.

3. The apparatus of claim 1, wherein said lid is configured to have an approximately circular shape with a diameter between 40 and 120 mm.

4. The apparatus of claim 1, wherein said lid is comprised of vinyl sheeting having a thickness of 4 to 60 mils achieving lateral stability by virtue of the coefficient of static friction at the contact interface between said surface and said rim.

5. The apparatus of claim 1, wherein said lid is comprised of material that includes plastic.

6. The apparatus of claim 1, wherein said lid is clear and contains markings to improve the visibility and usability of said lid.

* * * * *